US008696190B2

(12) United States Patent
Arakelyan et al.

(10) Patent No.: US 8,696,190 B2
(45) Date of Patent: Apr. 15, 2014

(54) METHOD AND APPARATUS FOR PREPARING AND INERTIAL PLACING WITH COMPACTING A CONCRETE MIX

(75) Inventors: Gamlet Gurgenovich Arakelyan, Nekrasova (RU); Artur Gamletjvich Arakelyan, Nekrasova (RU); Grant Gamletjvich Arakelyan, Nekrasova (RU)

(73) Assignee: Zaktritoe Akzionernoe Obschestvo ''Nauchno-Proektnoe Proizvodstvenno-Stroitelnoe Ob'edinenie "Grandstroi" (RU)

( * ) Notice: Subject to any disclaimer, the term of this patent is extended or adjusted under 35 U.S.C. 154(b) by 1055 days.

(21) Appl. No.: 12/655,012

(22) Filed: Dec. 22, 2009

(65) Prior Publication Data

US 2010/0165783 A1 Jul. 1, 2010

(30) Foreign Application Priority Data

Dec. 25, 2008 (RU) ..... 2008151523

(51) Int. Cl.
*B28C 5/06* (2006.01)

(52) U.S. Cl.
USPC ..... 366/2; 366/5

(58) Field of Classification Search
USPC ..... 366/3, 5, 6, 10, 11, 42, 54, 57, 2
See application file for complete search history.

(56) References Cited

U.S. PATENT DOCUMENTS 1,559,666 A * 11/1925 Bernier ..... 366/11
1,755,329 A * 4/1930 McCormack ..... 239/654
2,516,684 A * 7/1950 Doull et al. ..... 366/10

(Continued)

FOREIGN PATENT DOCUMENTS

RU 1789710 C 1/1993
RU 1818289 C 5/1993
RU 1838545 C 8/1993
RU 2149756 C 5/2000

OTHER PUBLICATIONS

Arakelyan G. "Ecoconcrete: technology and organization of restoring buildings and constructions"). M.: Stroyisdat, 2004, pp. 30-31.

(Continued)

*Primary Examiner* — Tony G Soohoo
(74) *Attorney, Agent, or Firm* — Yefim Kreydin

(57) ABSTRACT

The invention relates to methods and apparatus for a vibration-free placement of the concrete and for placement and enforced speed inertial compaction of the concrete under a high pressure. The method permits to optimize the values of the compaction factor of the concrete mix being placed without vibration. Whereupon, in the case of variation assigning and implementing (adjusting and optimizing) the integral indices of the mix, and/or the plume modes, and/or the space medium characteristics, increasing the concrete strength in early time of the concrete curing, increasing the width of the placed and compacted mix in one step of concreting, reducing the mix losses in the case of placing with compacting the concrete mix. The method implements a stage of concreting under super-high pressure using a speed force inertial characteristic of components, wherein the steps are joined into the continuous serial process of the steps of: preparing the mix, unloading and transporting thereof, reconstructing the stream, discharging the mix stream for placing with compacting thereof, particularly by means of stabilizing the uniformity of the concrete mix. The apparatus is designed for implementing the method.

12 Claims, 7 Drawing Sheets

(56) References Cited

U.S. PATENT DOCUMENTS

| | | | | | |
|---|---|---|---|---|---|
| 3,767,170 | A | * | 10/1973 | Morgenstern | 366/3 |
| 3,788,557 | A | * | 1/1974 | Breunsbach | 239/401 |
| 4,039,170 | A | * | 8/1977 | Cornwell et al. | 366/19 |
| 4,239,397 | A | * | 12/1980 | Sandell et al. | 366/3 |
| 4,264,212 | A | * | 4/1981 | Tookey | 366/3 |
| 4,293,227 | A | * | 10/1981 | Tanaka et al. | 366/11 |
| 4,295,744 | A | * | 10/1981 | Scriminger | 366/3 |
| 4,329,090 | A | * | 5/1982 | Teague et al. | 405/263 |
| 4,360,044 | A | * | 11/1982 | Wisneski | 141/9 |
| 4,390,281 | A | * | 6/1983 | Scriminger | 366/3 |
| 4,408,886 | A | * | 10/1983 | Sampson et al. | 366/13 |
| 4,931,098 | A | * | 6/1990 | Danielssen et al. | 366/3 |
| 5,102,228 | A | * | 4/1992 | Vine-Lott | 366/3 |
| 5,507,572 | A | * | 4/1996 | Shields et al. | 366/6 |
| 6,843,592 | B2 | * | 1/2005 | Taylor et al. | 366/18 |
| 7,438,507 | B2 | * | 10/2008 | Scharger | 366/10 |
| 7,513,963 | B2 | * | 4/2009 | Frank et al. | 366/18 |
| 2006/0013061 | A1 | * | 1/2006 | Bivens et al. | 366/16 |
| 2007/0125264 | A1 | * | 6/2007 | McVane | 366/8 |
| 2007/0125265 | A1 | * | 6/2007 | McVane | 366/8 |

OTHER PUBLICATIONS

Mechedlov-Petrosyan et al. “Vibration-free methods for concreting” in the collected works “Vibration-free methods in the concrete technology”, Proceedings, Vodgeo, No. 1, Kharkov, 1968,pp. 5-10.

* cited by examiner

METHOD AND APPARATUS FOR PREPARING AND INERTIAL PLACING WITH COMPACTING A CONCRETE MIX

This application is the United States national application of Russian Application RU2008151523 filed Dec. 25, 2008, the entire disclosure of which is incorporated herein by reference.

FIELD OF THE INVENTION

The invention relates to methods and apparatus for a vibration-free placement of the concrete, and more particularly to methods and apparatus for placement and enforced speed inertial compaction of the concrete under a high pressure. The invention could be used mainly for placing dry concrete mixes in solid raise of civil, industrial and other buildings and constructions, in reconstructing and strengthening thereof, specifically waterwork, port, navigation and other constructions requiring the underwater concreting, as well as in factory environment for manufacturing concrete and reinforced concrete products and structures.

BACKGROUND OF THE INVENTION

Known is the vibration-free method for concreting/placing with simultaneously compacting a concrete mix, which method being employed for forming plant cast reinforced concretes products and components, joint grouting prefabricated reinforced concrete, repairing building constructions, tunneling, etc., the method including combined in the unified technological process the steps of preparing by stirring, transporting, and placing the concrete mix under a pressurized air along with applying thereof onto a surface being concreted with the inertial placement, and the apparatus for implementing this, method, which apparatus comprising a mixing chamber, mechanisms for unloading the chamber and transporting the mix via a pipe-line, at which end a cone nozzle for discharging is mounted. (Mechedlov-Petrosyan et al. "Vibration-free methods for concreting" in the collected works "Vibration-free methods in the concrete technology"), Proceedings Vodgeo, no. 1, Kharkov, 1968, pp. 5-10).

The disadvantage of the known method consists in a low speed of the inertial placement, which limits the technological possibilities to the use of only fine aggregate mixes, requires the multiple layering, is impossible for placing onto a horizontal surface of the type "ceiling", is impossible for placing in the underwater concreting. The disadvantages are responsible, particularly, for destroying the uniformity (obtained by stirring) of the mix when unloading, transporting, discharging for placing along with compacting.

Known are the method and apparatus for preparing concrete mixes by stirring, which method including the steps of enforced displacing a material with the distributing member (RU 2149756, 1997).

The disadvantage of the known technical solution consists in that displacing the material when stirring is carried out vertically under the action of gravity, and unloading the material takes place in various points of the mixer, which disturbs the mix uniformity in unloading.

Known are the method and apparatus for ejecting a concrete mix for unloading with simultaneous supplying a pressurized air into the reservoir being unloaded (SU 1838545, 1991).

The disadvantage of the technical solution consists in a low accuracy of dosing the material feeding when unloading.

Known are the method and apparatus for dosing when unloading a concrete mix by ejecting at the input of transporting pipe-line (SU 1789710, 1990).

The disadvantage of the technical solution consists in disturbing the mix uniformity when dosing due to the vertical scheme of the unloading.

Also known is the method for preparing and inertial placing with compacting a concrete mix in a vibration-free placement of concrete, which method including a step of concreting under super-high pressure using a speed force inertial characteristic of components, which step of concreting being carried out by steps of: cyclic enforced preparing the mix in a mixing chamber; transporting the mix via a pipe-line; discharging in a stream for placing with compacting by sputtering the stream with a plume of the inertial displacement of the concrete mix in the space taking into account the plume position and shape (ARAKELYAN G. "Eco-concrete: technology and organization of restoring buildings and constructions"). M.: Stroyisdat, 2004, pp. 30-31).

Also known is the apparatus for preparing and inertial placing with compacting a concrete mix for vibration-free concreting, which apparatus comprising an enforced action mixing chamber in the form of a horizontal cylindrical reservoir for stirring having a pressure inlet, a loading port, and an unloading mechanism in the bottom portion; a pneumatic trans-port system in the form of a pipe-line; and a discharging device for placing and compacting the mix; a central working shaft having a drive and being mounted in the mixing chamber; blades each of which being mounted at an angle between the plane thereof in the vertical position and the shaft axis at the free ends of holders fixed to the central working shaft perpendicularly to the horizontal axis thereof, configured for moving the holders along the axis; an unloading mechanism in the bottom portion of the mixing chamber being made in the form of a chamber with an ejecting device in the form of an ejector nozzle and ejector diffuser coupled to the pneumatic transport pipe-line, at which output a discharging device for placing and compacting the mix being disposed, which discharging device being made in the form of the placing nozzle (SU 1818289, 1980).

The disadvantage of the known method and apparatus consists in a low speed of the mix in inertial placing up to 200 m/sec, beginning of disturbances of non-recoverable mix in homogenuity when unloading the mix, transporting thereof, placing thereof with compacting, which excludes forming a homogenous plume of the inertial displacement of the concrete mix in the space for placing the mix, particularly in environments having various densities and on surfaces disposed at various angles relative to the horizon in order for achieving the maximal compaction factor of the mix being placed without vibration.

SUMMARY OF THE INVENTION

The technical problem consists in increasing the efficiency of the vibration-free placement and compaction of the concrete mix.

The technical result consists in optimizing the value of the compaction factor of the concrete mix being placed without vibration, and thereby, in the case of variational assigning and implementing (adjusting and optimizing) the integral indices of the mix, and/or the plume modes, and/or the space medium characteristics, increasing the concrete strength in early time of the concrete curing, increasing the width of the placed and compacted mix in one step of concreting, reducing the mix losses in the case of placing with compacting the concrete mix.

The solution of the set problem is ensured by continuity of the processes for creating and maintaining the mix uniformity in the unified system of serially connected steps united by a unified pressure energy source, and by existing the additional special operations related to the modes, with the possibility for adjusting and optimizing the compaction factor of the concrete mix according to complex indices of the mix parameters, and/or functional modes of the plume, and/or space medium characteristics.

Figure 1:
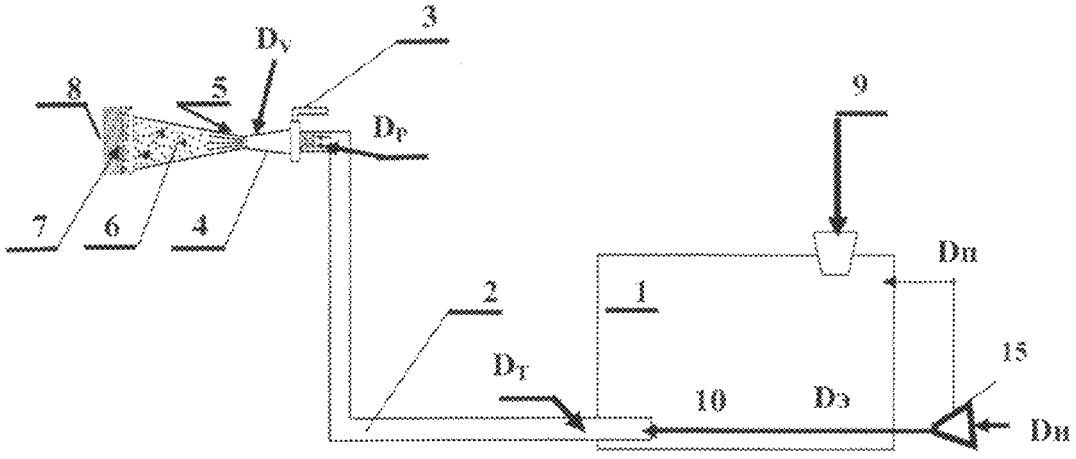
FIG. 1 represents the block diagram of the method implementation.

The reference numbers in all drawings have the following meanings:

1—Mixing chamber for stirring;
2—Pipe-line of the pneumatic transport;
3—Aerosol wetting of the mix;
4—Nozzle for discharging and placing the concrete mix;
5—Plume mouth for placing and compacting the mix;
6—Inertial plume for placing and compacting the concrete mix;
7—Mix deposited onto the surface;
8—Groundwork for deposing the mix in concreting;
9—Loading hatch of the cyclic loading of the mix components;
10—Unloading the mix by means of ejecting;
11—Loading level of the mixer;
12—Gravity mix displacement in stirring;
13—Vertical direction of the mix displacement;
14—Unloading mechanism;
15—Unified pressure energy source;
16—Horizontal direction of the mix displacement in stirring;
17—Horizontal direction of the mix displacement in discharging;
18—Dispensers of the aerosol wetting of the mix;
19—Ejector nozzle for unloading from the mixing chamber;
20—Axis of the angular direction of the stream relative to the horizontal axis at $\gamma=0°$;
21—Axis of the mix plume displacement trajectory at $\gamma=0°$;
22—Axis of the angular direction of the stream relative to the horizontal axis at $\gamma=-(3°\text{-}6°)$;
23—Axis of the mix plume displacement trajectory at $\gamma=-(3°\text{-}6°)$;
24—Axis of the angular direction of the stream relative to the horizontal axis at $\gamma=(40°\text{-}50°)$;
25—Axis of the inertial mix plume displacement trajectory at $\gamma=-(40°\text{-}50°)$;
26—Axis of the angular direction of the stream relative to the horizontal axis at $\gamma=(70°\text{-}80°)$;
27—Axis of the mix plume displacement trajectory at $\gamma=-(70°\text{-}80°)$;
28—Axis of the mixing chamber for stirring;
29—Reverse drive of the mixing chamber for stirring;
30—Blades for stirring on holders;
31—Inner surface of the nozzle of the complex configuration in the form of the hyperboloid semiplane;
32—Semi-blade;
33—Amount of the blade overlap;
34—Blade angle;
35—Diffuser portion of the discharge nozzle;
36—Interface plane of the inner surface of the nozzle of the complex configuration with the diffuser plane;
$D_V$—Pressure in the plume mouth;
$D_P$—Operating pressure at the output of the transport system of the pneumatic transport;
$D_T$—Pressure at the input of the transport system of the pneumatic transport;
De—Ejection pressure;
$D_{\Pi}$—Boost pressure;
$D_t$—Diameter of the pneumatic transport pipe-line;
$D_C$—Diameter of the output opening of the nozzle;
$v_{\pi}$—Velocity of the laminar movement;
$v_{\pi\text{-}m}$—Velocity of the transition from the laminar movement to the turbulent movement;
$v_m$—Velocity of the turbulent movement;
$\gamma$—Angle of the inertial displacement direction of the plume relative to horizon;
$L_S$—Length of the mix discharging nozzle;
$L_D$—Length of the diffuser portion of the mix discharging nozzle;
$\phi_s$—Conicity of the diffuser portion of the mix discharging nozzle;
$\phi_f$—Conicity angle of the plume;
$V_Z$—Loading volume of the chamber for stirring;
$V_C$—Volume of the mixing chamber for stirring.

DESCRIPTION OF THE PREFERRED EMBODIMENTS

One of the reserves for hardening concretes consists in the right choice of the technological means for preparing and processing the concrete mix taking into account the structuring processes. The choice of the means affects these processes, enhancing the effect of the factors related to increasing the strength and, on the contrary, decreasing the effect of the factors reducing the strength. Such an approach permits for estimating and refining one or another technological methods in terms of influencing thereof on forming of the coagulation structure and, finally, strengthening the concrete. Putting one of another technological equipment into service, taking into account the product nature and manufacturing conditions, the special attention, when debugging those equipment, should be given to the intensity of impacts that would be applied to the concrete mix during the process for preparing, delivering, placing, forming and compacting thereof.

Inertial placing is the method for placing with the vibration-free compacting (placing combined with compacting) the concrete mix by means of the energy of the moving mix stream, in which case generally in such systems, the margin of energy of the mix stream moving in the space is determined by the margin of energy at the output of the pneumatic transport system for transporting the mix via the pipe-line. The margin of energy is characterized by the stream velocity (V) immediately at the beginning of the inertial displacement thereof. The inertial stream in the form of the plume disperses (places with compacting) the concrete mix onto the surface (S), and in so doing, the inertial pressure ensuring the compaction at the surface should not, on one hand, create loads destroying the components in compacting, and should, on the other hand, ensure the needed or maximum possible compaction factor ($K_U$) of the concrete mix. The latter provides the optimal indices of the concrete, specifically the enhanced strength indices of the concrete in early periods of hardening.

The parameters characterizing the processes in the discussed system, which affect directly or indirectly the quantitative and qualitative characteristics of the placed and compacted concrete, relate functionally to the three characteristic groups:

integral indices of the mix parameters ($I_C$), to which could be assigned, particularly, the following: the pulp density $\rho$, the coefficient $\mu$ of the pulp uniformity variation in the plume mouth, the mix water saturation B, the coefficient $K_Z$ of the volume load of the trans-port system, the strength limit $R_P$ when cracking the filler;

functional modes of the plume of the inertial mix stream ($I_f$), to which could be assigned, particularly, the following: the pulp velocity V in the plume mouth, the plume area S at the placed surface, the plume conicity angle $\phi_f$. In the latter case, the plume pressure gained by the momentum at the placed surface at the area S with the plume angle $\phi_f$ must not exceeds the strength limit ($R_P$) when cracking the filler;

the space medium characteristics ($I_P$), to which could be assigned, particularly, the following: the distance h from the plume mouth to the mix placement surface, the coefficient $K_n$ of the direction of the plume inertial displacement relative to the horizon, the dynamic coefficient $\upsilon_P$ of the space actuation medium.

One of the essential factors defining the uniformity of grain packing in the concrete consists in the uniformity of the concrete mix in placing, which is evaluated by the variation coefficient. The mix uniformity is provided, at all stages, by the continuity of the processes including the steps of: preparing the mix by combined stirring; unloading by the ejection combined with changing the mode of the combined stirring; transporting the mix in the form of air pulp; discharging along with placing and compacting; wherein the process unity is ensured by performing the operations from the unified boost energy source.

The method implements the step of concreting under the super-high pressure using the speed force inertial characteristics of the components, in which method the steps being united into the continuous unified serial process for preparing the mix, unloading and transporting thereof, reconstructing the stream, discharging the mix stream for placing thereof along with compacting.

The questions for optimizing and identifying the technological processes for placing and compacting the concrete mix when vibration-free concreting could not be solved without solving the questions for forecasting and active controlling the structure of the speed inertial streams of the concrete mix.

The force inertial characteristic of the material having mass m establishes the relationship of the sum of the kinetic energy of the individual moving particles ($K_i$) and the velocity V of their inertial movement $$\left(K = \sum_{i=1}^{n} \frac{m_i V}{2}\right);$$

on the other hand, in the impact of the particle moving at the velocity V, the energy is released, which could, depending on the amount thereof, application direction and other external and inner factors of the system and medium, disperse the particles on the rebound from the surface in the case of impact, introduce the incoming particles onto the previously placed particles, and create the ever-growing massive, or destroy, in the case of the sufficiently great kinetic energies, the surface, i.e., the previously coming particles.

The unified hermetically sealed system (FIG. 1) ensures the smoothing of the boost pressure ripples in the system, which ripples are caused by conditional changes in various technological processings: stirring, unloading for transporting, transporting, and discharging for placing with compacting the mix. The ripples smoothing takes place also due to the existence of the damping effect from the boost pressure ($D_\Pi$).

Figure 3:
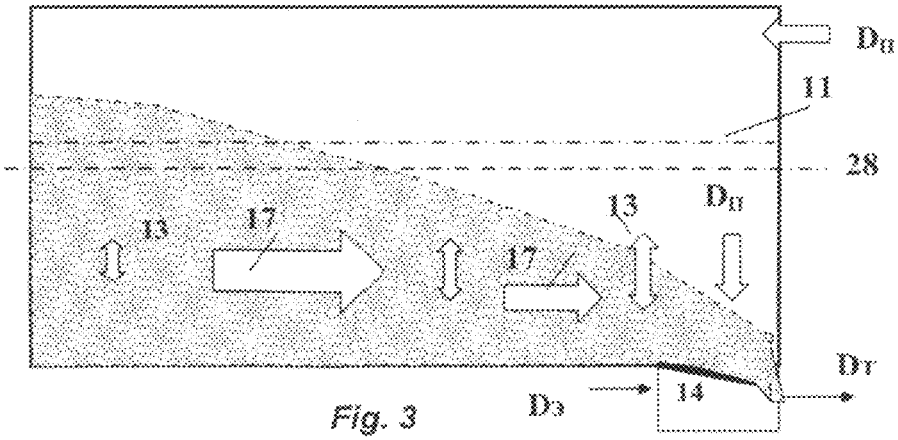
FIG. 3 represents the directions of the mix displacement in the mixing chamber when unloading from the chamber.

The mix is prepared cyclically in the mixing chamber (1), the volume of the preparation in each cycle being defined by the chamber volume ($V_C$). The cyclic enforced mix preparing in the mixing chamber including the cyclic loading (9) is performed by stirring along with the combined displacing (12, 13, 16) the components in the mixing chamber for the distribution uniformity of the components grains of the different fractions in the mix, and, at the same time, for preparing the mix condition to the unloading, particularly, by means of displacing thereof relative to the unloading device (FIG. 3).

One of the embodiments for performing steps of the enforced preparation including the cyclic loading (9) into the chamber and stirring along with the combined displacing (12, 13, 16) the components in the mixing chamber is the combination of displacing the individual mix portions simultaneously by gravity (12), enforcedly vertically (13) and enforcedly horizontally (16).

Figure 2:
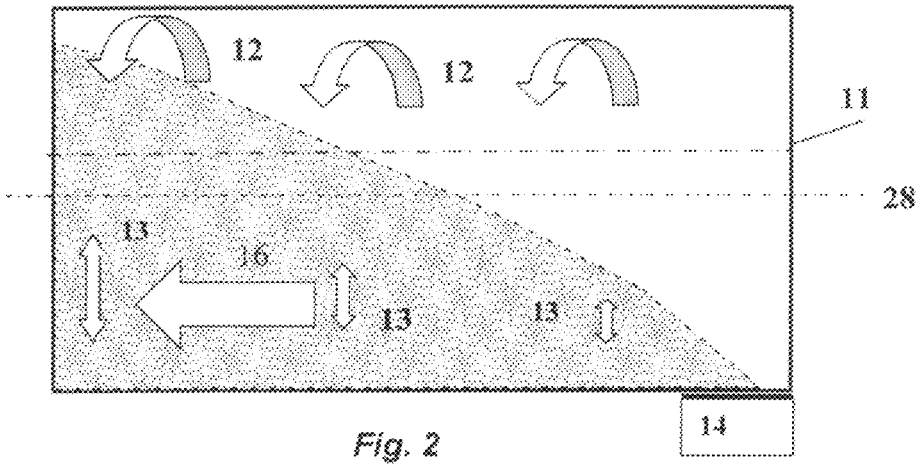
FIG. 2 represents the directions of the mix displacement in the mixing chamber when stirring.

The combined complex mix displacement in stirring (FIG. 2), for example, enforcedly vertically and horizontally, and at the same time by gravity, excludes the occurrence of the mix layering effect in stirring. Moreover, the horizontal mix displacement towards from the unloading device provides additionally the uniformity in feeding the material in unloading (FIG. 3), and changing the mix direction in unloading provides also the additional stirring. The enforced stirring performed vertically-horizontally and by gravity provides additionally the stabilization of the momentum in the mix in time in discharging (ripple smoothing) for placing with compacting.

In preparing the mix, in order for enhancing the stirring efficiency, the step of cyclic enforced preparing could include the cyclic loading in the volume: $V_Z=K\cdot V_C$, where $V_Z$ is for loading volume, $m^3$, $V_C$ is for volume of the mixing chamber, $m^3$, K is for concrete mix yield factor equal to $0.8\geq K\geq 0.6$; or in the volume: $V_Z=0.7\cdot V_C$, at the concrete mix yield factor $0.8<K<0.6$. The stirring efficiency could be increased in other way, for example, by altering the stirring speed.

Prior to unloading the mix from the chamber, it is expedient (awhile (3 to 10 seconds) for preparing to the step of placing) the system path including the ejecting device (10, 14, 19), pneumatic transport (2), discharging device for placing and compacting (4, 35), the space medium of the inertial displacing the mix (5, 6), and the surface (7, 8) for placing with compacting to be treated by purging the path with the clean air having the pressure equal to the discharging ejection pressure $De=D_{\Pi}+(D_T*K_{tp}*K_P)$, where De is for ejection pressure, $D_P=f(V)$ is for operating pressure at the output of the transport system, V is for pulp velocity in the plume mouth, m/sec, $D_{\Pi}=(0.05\text{-}0.15)*De$ is for boost pressure in the chamber, $D_T$ is for pressure at the input of the transport system, $K_{tp}$ is for transportation loss factor, $K_p$ is for pressure loss factor in unloading.

The absence of the path preprocessing reduces the method efficiency at the initial stage of placing and compacting, but does not affect significantly in the main stage of the method implementation.

After the main stirring by the combined displacing the components, the mix occupies the position displaced relative to the unloading device (FIG. 3). The step of discharging the mix from the chamber into the transport system is performed by ejecting combined with changing the mode of the combined stirring. It is possible to carry out the step of discharging the mix from the chamber by ejecting, and to carry out the step of changing the mode of the combined stirring by reversing the direction of the horizontal enforced displacement of the mix in stirring (17) and by creating in the chamber the boost pressure $D_{\Pi}=(0.05\text{-}0.15)*D_{\exists}$, where $D_{\exists}$ is for ejection pressure. The steps of unloading ensure the safety of the mix uniformity for transporting thereof via the pipe-line by the pneumatic transport.

The uniformity of the mix in unloading thereof from the mixing chamber into the transport system is achieved by that the step of unloading the mix is carried out by reversing the direction of the components displacement in the mixing chamber and forming the stress of the pneumatic transport system from the pressure boost of the mixing chamber simultaneously with creating the pressure for ejecting the concrete mix stream.

The ejection air flows out with a great velocity under the pressure $D_3$ into the mixing chamber 14 and creates negative pressure therein. This results in entering the mix being displaced under the pressure $D_{\Pi}$ into the chamber. The working flow carrying the mix being displaced tears along therewith into the nozzle diffuser, where the mix decreases its velocity and increases the forward pressure, thus ensuring the mix delivery into the transport system under the pressure $D_T$.

The mix is transported in the form of the air pulp in the turbulent mode of the mix movement.

Figure 4:
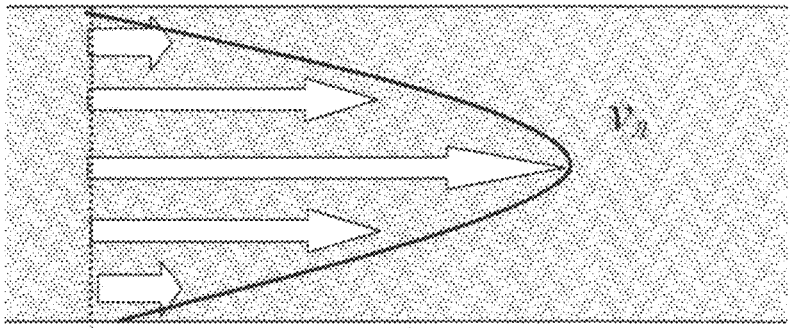
FIG. 4 represents the velocity profile of the mix displacement via the pipe-line in the laminar flow.

The turbulent mode of the movement, in contrast to the laminar one, emerges at great stream velocities. The laminar movement (FIG. 4) is the movement, in which separate layers slide relative to each other without mixing, and is characterized by the presence of the parabolic leading front, which results in reducing the velocity near walls and disturbing the mix uniformity, when small filler particles begin to slow near walls including the seediness of both the walls and grains of the displacing pulp.

Figure 5:
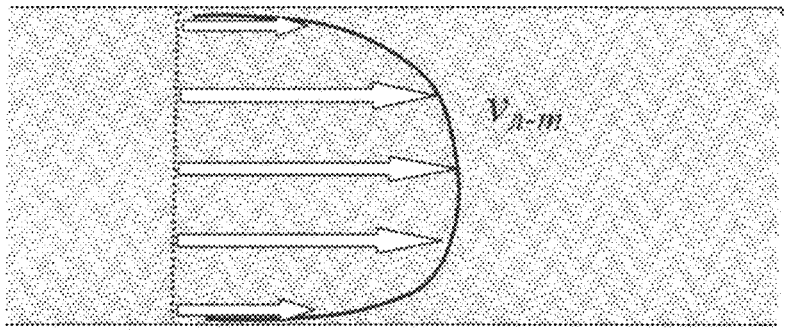
FIG. 5 represents the velocity profile of the mix displacement via the pipe-line in the transition from the laminar flow to turbulent flow.
Figure 6:
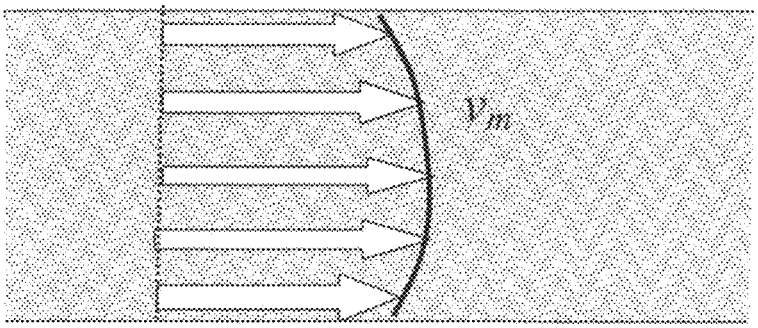
FIG. 6 represents the velocity profile of the mix displacement via the pipe-line in the turbulent flow.

If the flow velocity exceeds the determined critical value, the laminar movement becomes unstable (FIG. 5) and passes into the turbulent one (FIG. 6). In the stationary turbulent movement, the flow velocity in the given place accomplishes chaotic oscillations in magnitude and direction. But the average velocity in the given place of the pipe remains steady in magnitude and is direct along the pipe axis. The profile of the average velocity (v) in the pipe is characterized (in comparison with the laminar movement) by the faster increase of the velocity near walls (in the boundary layer) and lesser curvature in the middle portion, which tends to occupy the entire plane of the pipe cross-section perpendicularly to the movement direction.

The behavior of the moving mix depends on the relative role of the dynamic resistance and viscous friction. This role is characterized by the dimensionless Reynolds number: $Re=(l^2\rho v^2)/(\eta l v)=(l\rho v)\eta$, where l is for typical linear size (in the case of flow over a body, this is the length or cross-sectional size, in the case of flow in long pipes, this is the pipe diameter of the pipe), $\eta$ is for viscosity, $\rho$ is for density.

At great velocities for the air pulp having relative low average density, the resisting force for the movement are determined generally by density $\rho$ rather than viscosity $\eta$. In this case, the resisting force (F) is referred to as hydraulic and could be expressed by the following dependence: $F=CS\rho v^2$, where S is for area of the cross-section of the body being moved, and the coefficient C depends on the body shape and surface texture. For a sphere that could be considered as an approximation to the filler form, the value of the C is within the range of 0.05 to 0.2, and for the filler having the flaky form (an analog being a plate), the value of the C is within the range 0.50 to 0.55.

The set forth relates to the mix behavior both in the pipeline and in the inertial movement in the space. In the latter case, it should be additionally taken into account the stream "dispersion", changing the form and structure thereof.

In the case of exceeding the transportation velocities ensuring the turbulent movement, at the steps of discharging the concrete mix from the pneumatic transport, placing with compacting thereof in depositing onto the surface or form being concreted, the mix velocity in placing is restrained by the strength amount of the surface being concreted. The minimal velocity must ensure the uniformity of the impact along the surface in concreting, and is determined as well with the needed value of adhesive processes during the interaction of the moving mix with the surface being concreted.

The low pulp density ($\rho$) of 5 to 50 $kg/m^3$ accepted in the present method, at great pulp velocities in the plume mouth (V) of 200 to 500 m/sec, permits for applying the origination mechanism of high-speed gas flows. In such a case, the properties of the pulp and components thereof are taken into account additionally.

In the indicated interval of the pulp density, the uniformity of the pulp is ensured. At the lesser density, a failure occurs due to the non-uniformity in feeding the components in the unit of volume per unit of time during the step of unloading from the chamber, and at the great density index, the movement resistance force is changed because of changing the ratio viscosity/density, which results in the retarding effect and, subsequent stop of the transportation.

In order for limiting (adjusting) the plume enlarging degree, the diffuser is mounted.

In the inertial movement of the mix in the space, the greatest intensity (of the pressure) is noted in the direction of the closest (to the symmetry axis of the flow) points of the nozzle exit boundary. As has been found, this effect is observed plainly in the modes of fore-expanded and sub-expanded flow at the values of the nozzle and plume angles in the vertical plane of the order of 12 to 15 degrees for the fore-expanded flow and of 6 to 12 degrees for the sub-expanded flow. Such an effect is not observed for the over-expanded flows at the values of the nozzle angle more than 15 degrees; moreover, the stream flow destabilization is observed for the angle more than 15 degrees and less than 6 degrees.

Prior to the step of discharging the mix stream from the transport system in order for placing and compacting thereof, the step of reconstructing the mix stream being transported is performed by shaping the complex form of the stream restrained on the surface by the plane. One of embodiments of the surface forming the stream being reconstructed could be the surface of the plane formed by complex rotation of the second order curves, for example, the surface described by the hyperboloidal semiplane (the "saddle" type) having the diffuser stream expansion.

One of the embodiments for performing the step of reconstructing the mix stream being transported by shaping the complex form of the stream consists in carrying out the aerosol wetting the mix with the counter stream.

In the case of the relative uniform distribution of the parameters at the nozzle exit (the nozzle mouth), which is ensured for the claimed method and apparatus by the main parameter, i.e., the pulp uniformity in the nozzle mouth, the fore-expanded flows have the following clearly defined particularity: the flow expands in a greater degree in the direction of the closest (to the symmetry axis of the flow) points of the nozzle exit boundary. The main parameter enhancing the expanding non-uniformity effect is in applying the sub-expanded flows. These phenomena, i.e., the presence of the more active processes along the symmetry axis of the inertial stream decreasing to the periphery ensure expressing the air from the center to the periphery with the simultaneous expressing the excess of the unbound water at the placed surface, which increases finally the concrete strength indices, specifically at the initial period of hardening.

It is possible to apply the flows from the nozzles of the triangle, rectangular and other forms, herewith the general regularity of the compaction factor is maintained, but the particular case requires for obtaining other empirical dependencies and has the essential impact onto the flow structure.

In order for minimizing the compaction factor and reducing the time for hardening the concrete structures on the cement binder, the step of discharging is carried out using the speed force inertial characteristic of the components of the reconstructed stream for placing with compacting by sputtering the stream with the plume of the inertial mix displacement in the space, taking into account the plume position and shape, with the possibility for adjusting and optimizing the compaction factor of the concrete mix according to complex indices of the mix parameters, and/or functional modes of the plume, and/or space medium characteristics in accordance with the dependence: $K_U=F(I_C, I_f, I_P)$, where $K_U$ is for compaction factor at the placing surface, F is for functional of the dependence of the compaction factor on the complex indices, $I_C$ is for integral complex of the mix parameter indices, $I_f$ is for integral complex of the indices of the functional modes of the plume, $I_P$ is for integral complex characteristics of the space medium.

The compaction factor, i.e., the ratio of the average density to the true density depends on the complex of the mix parameter indices, plume modes of the inertial displacement of the concrete mix in the space, and characteristics of the medium, in which the mix stream is displaced by inertia. Assuming the true density for the specific conditions as a constant value, it is necessary, in order for increasing the compaction factor of the concrete mix, to take into consideration the complex indices:

the mix parameters reflecting the indices of the mix component properties, the plume parameters, i.e., the indices reflecting the geometry and the velocity characteristics of the plume source, the parameters of the mix displacement in the space, i.e., the parameters reflecting the dynamic resistance of the medium.

The change of the complex indices changes the average density of the mix and hence (in the case of the constant true density) changes the compaction factor.

The possibility for adjusting and optimizing the compaction factor of the concrete mix according to the complex indices in a particular case could be characterized by the dependence:

$$K_U=F(\rho,\mu,K_Z,R_P,V,S,\phi_f,h,K_n,\upsilon_P), \text{ where}$$

$\rho$, $\mu$, B, $K_Z$, $R_P$ is for integral complex $I_C$ of the mix parameter indices;

V, S, $\phi_f$ is for integral complex $I_f$ of the functional plume mode;

h, $K_n$, $\upsilon_P$ is for integral complex $I_P$ of the space medium characteristics;

$\rho$ is for pulp density of 5 to 50 kg/m$^3$;

$\mu$ is for coefficient of the pulp uniformity variation in the plume mouth;

B is for mix water saturation;

$K_Z$ is for coefficient of the loading volume of the transport system;

$R_P$ is for strength limit when cracking the filler;

V is for velocity of the plume at the placement surface;

$\phi_f$ is for plume conicity angle;

h is for distance from the plume mouth to the mix placement surface;

$K_n$ is for coefficient of the direction of the plume inertial displacement relative to the horizon;

$\upsilon_P$ is for dynamic coefficient of the space actuation medium.

For the determined particular values of the parameters in adjusting the optimal compaction factor $K_U$ of the concrete mix within the range of $0.95 \leq K_U < 1$, in order: for optimizing the integral indices of the parameters of the mix to be placed and compacted by the concreting plume according to the index of the concrete compaction/pulp density adjustment factor; for minimizing the variation coefficient of the pulp uniformity; for establishing the volume loading coefficient of the transport system; and taking into account the conditions of restraints on the mix water saturation and on the strength limit when cracking the coarse filler, the value $K_U$ could be evaluate by the dependence of the product of the complexes of the mix parameter indices, functional modes of the plume and space medium characteristics according to the empirical dependence:

$$K_U = (I_C * I_f * I_P) = \frac{\rho V^2 K_z}{hSB\upsilon_P \mu R_P} * \left(1 + \frac{\mathrm{Sin}(\gamma)}{gh}\right),$$

where $K_U$ is for mix compaction factor at the placing surface;

$I_C$ is for integral indices of the mix parameters;

$I_f$ is for functional modes of the plume;

$I_P$ is for space medium characteristics;

$$I_C = \frac{\rho K_Z}{B_f \mu R_P};$$

$$I_f = \frac{V^2}{S};$$

$$I_P = \left(\frac{1}{h\upsilon_P}\right) * \left(1 + \frac{\mathrm{Sin}(\gamma)}{gh}\right);$$

$$S = f(h, \varphi_f);$$

$$\left(1 + \frac{\mathrm{Sin}(\gamma)}{gh}\right) = K_n;$$

under the following ratios of the integral indices of the mix parameters, functional modes of the plume and space medium characteristics:

pulp density (ρ) of 5 to 50 kg/m$^3$;

pulp velocity in the plume mouth (V) of 200 to 500 msec;

volume loading coefficient of the transport system $K_Z=\rho/(V*\rho_b)$;

density of the normal heavy concrete ($\rho_b$) of 2000 to 2500 kg/m$^3$;

distance from the plume mouth to the mix placement surface (h) of 0.1 to 0.5 m;

plume area at the placed surface $S=h*tg(\phi_f/2)$, m$^2$;

plume conicity angle ($\phi_b$) of 6 to 15 degrees;

mix water saturation (B) of 50 to 250 l/m$^3$;

dynamic coefficient of the space actuation medium ($\upsilon_P$) of 0.02 to 0.1 kgf*sec;

coefficient of the pulp uniformity variation in the plume mouth (μ) of 0.02 to 0.12;

strength limit when cracking the filler ($R_P$) of 1 to 100 kgf/m$^2$;

angle of the inertial displacement direction of the plume relative to horizon (γ) from minus 90 to plus 90 degrees;

$$\left(1 + \frac{\mathrm{Sin}(\gamma)}{gh}\right) = K_n$$

is for coefficient of the inertial displacement direction of the mix in the space;

g is for normal acceleration.

Figure 7:
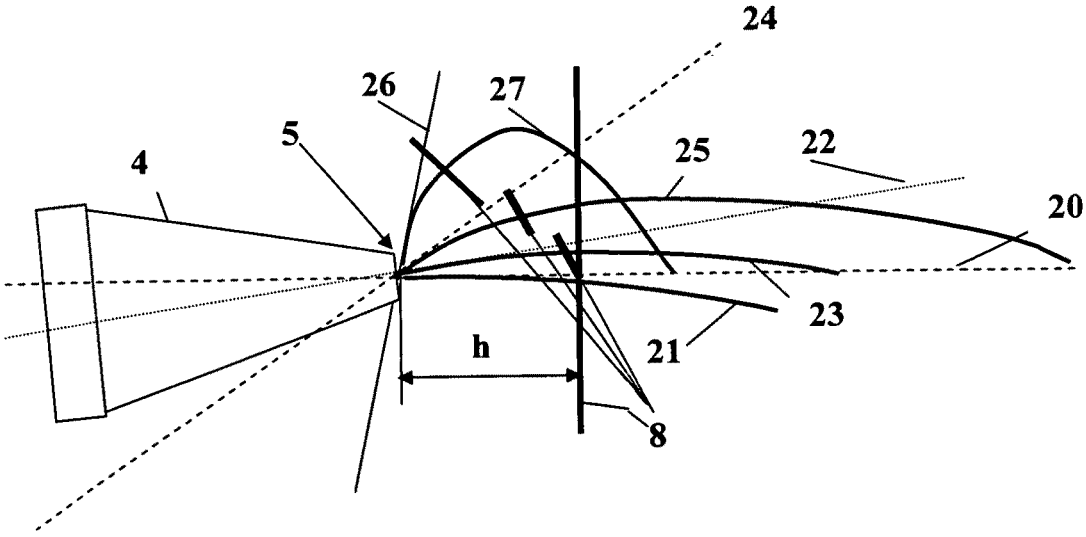
FIG. 7 represents inertial trajectories of the mix displacement in the space.
Figure 8:
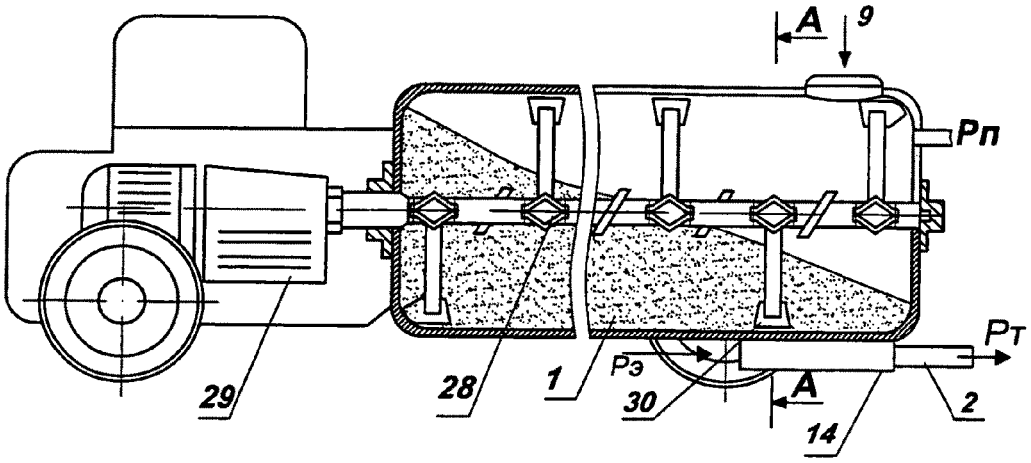
FIG. 8 represents the cross-section of the mixing chamber.
Figure 9:
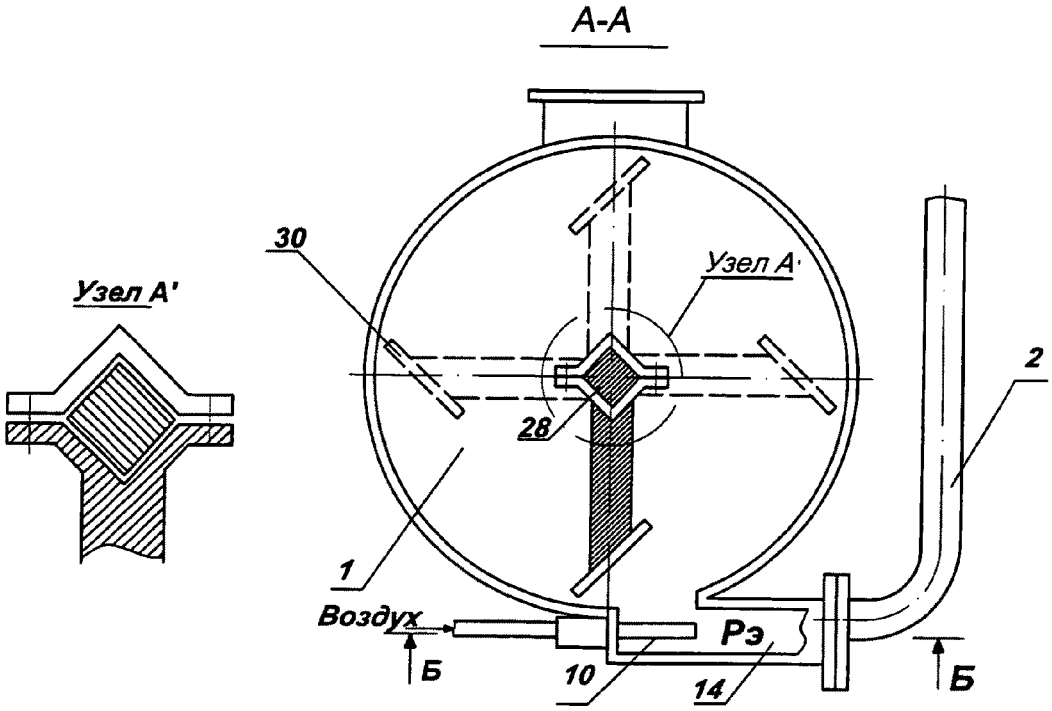
FIG. 9 represents the section taken along the line A-A in FIG. 8.
Figure 10:
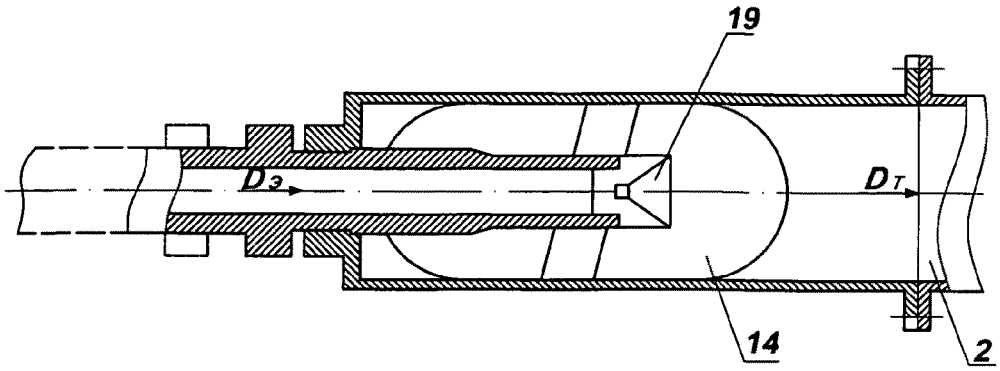
FIG. 10 represents the ejector device of the unloading mechanism (the plan view B-B in FIG. 9 from the side of unloading the mix)
Figure 11:
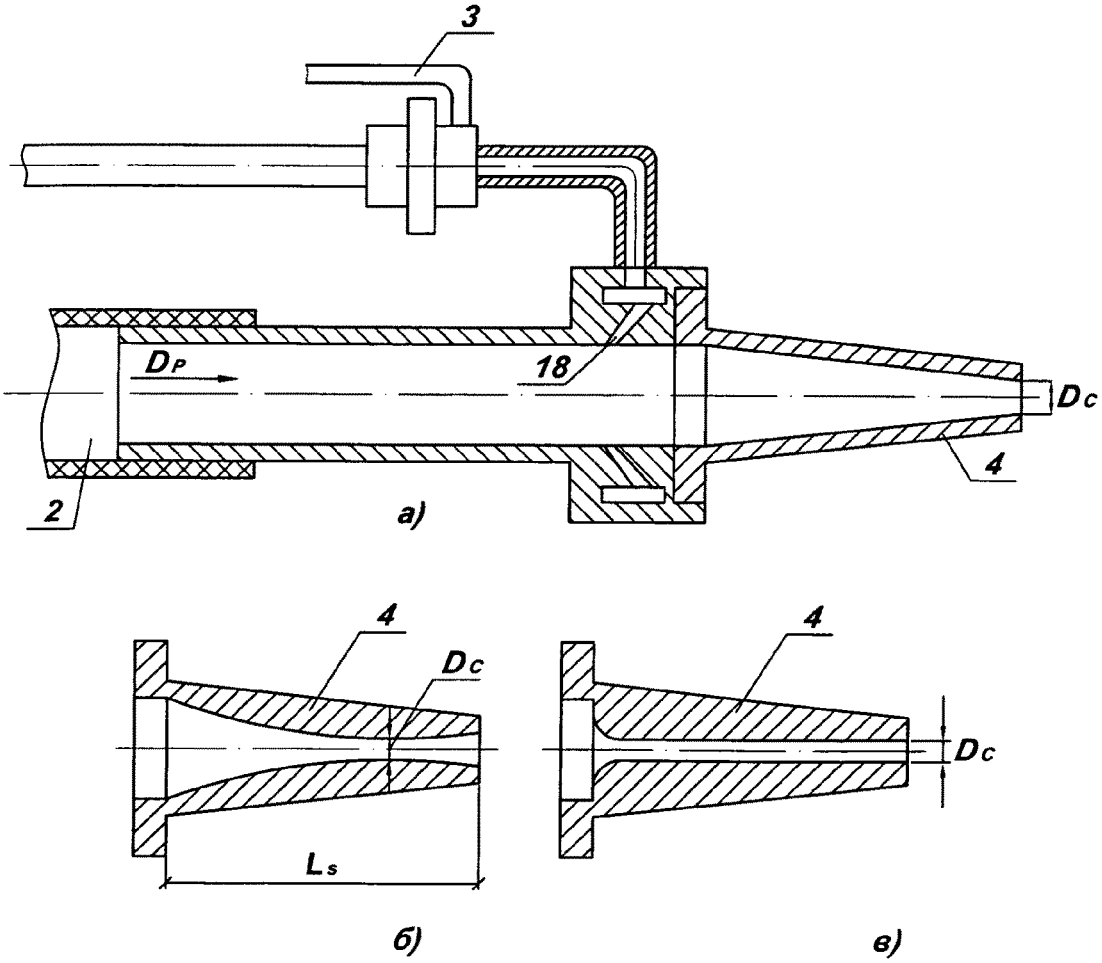
FIG. 11 represents the special device for discharging from the transport system in the form of a nozzle: a) the conical nozzle, b) the nozzle having a special complex configuration, c) the straight-flow nozzle.

Herewith, the step of transporting the mix via the pipe-line is carried out by the pneumatic transport in the form of the air pulp in the turbulent mode of the movement thereof on the basis of the Reynolds number Re≥1200, in which case, prior to the step of discharging the mix stream for placing and compacting the mix, it is efficient to carry out the step of reconstructing the mix stream being transported by shaping the complex form of the stream restrained at the surface with the second-order plane formed by the hyperboloidal semi-plane along with widening the stream in shaping the plume; the step of discharging the reconstructed stream for placing with compacting by sputtering the stream with a plume of the inertial displacement of the concrete mix in the space is carried out along with orienting the plume axis perpendicular to the concreting surface (FIG. 7) using the speed force inertial characteristics of the mix components taking into account the plume position and shape.

The Table 1 represents the results of the optimization on the basis of restraining the compaction factor within the range of $0.95 \le K_U < 1$.

TABLE 1

Optimization of the plume modes, medium and mix parameters on the value of the mix compaction factor on the basis of restraining $0.95 \le K_U < 1$ for concretes having the filler aggregate size less than 16 mm $|K_U = ((\rho * V\hat{}2 * (\rho/(V * \rho b))/(h * S * B * \mu * \upsilon))/(R_P)|$

| Nos | ρ | V | υ | h | S | ϕ | B | μ | $R_P$ | γ | $K_U$ |
|---|---|---|---|---|---|---|---|---|---|---|---|
| Average optimal indices for different angle of the plume direction | | | | | | | | | | | |
| 1 | 27.0 | 250 | 0.06 | 0.90 | 0.02 | 9.95 | 150 | 4.00 | 60.00 | 0.00 | 0.97*) |
| 2 | 27.0 | 250 | 0.06 | 0.90 | 0.02 | 10.50 | 150 | 4.00 | 60.00 | 90.00 | 0.97*) |
| 3 | 27.0 | 250 | 0.06 | 0.90 | 0.02 | 9.40 | 150 | 4.00 | 60.00 | −90.00 | 0.97*) |
| 4 | 27.0 | 250 | 0.06 | 0.90 | 0.02 | 10.25 | 150 | 4.00 | 60.00 | 45.00 | 0.99*) |
| 5 | 27.0 | 250 | 0.06 | 0.90 | 0.02 | 9.55 | 150 | 4.00 | 60.00 | −45.00 | 0.97*) |
| Maximal limit state of the pulp density | | | | | | | | | | | |
| 6 | 49.0 | 500 | 0.06 | 1.50 | 0.06 | 10.40 | 200 | 4.00 | 60.00 | 0.00 | 0.95 |
| 7 | 50.0 | 500 | 0.06 | 1.50 | 0.06 | 10.40 | 200 | 4.00 | 60.00 | 0.00 | 0.99*) |
| 8 | 51.0 | 500 | 0.06 | 1.50 | 0.06 | 10.40 | 200 | 4.00 | 60.00 | 0.00 | 1.03*) |
| Minimal limit state of the pulp density | | | | | | | | | | | |
| 9 | 19.0 | 500 | 0.06 | 0.90 | 0.02 | 9.95 | 150 | 4.00 | 60.00 | 0.00 | 0.96 |
| 10 | 7.9 | 500 | 0.06 | 0.90 | 0.01 | 9.95 | 150 | 4.00 | 60.00 | 0.00 | 0.97*) |
| 11 | 5.0 | 500 | 0.06 | 0.90 | 0.00 | 9.95 | 150 | 4.00 | 60.00 | 0.00 | 0.96*) |
| 12 | 4.9 | 500 | 0.06 | 0.90 | 0.00 | 9.95 | 150 | 4.00 | 60.00 | 0.00 | 0.92*) |
| Maximal limit states with the simultaneous exceeding the values of the pulp density (ρ), velocity (V), distance (h), and water saturation (B) | | | | | | | | | | | |
| 13 | 50.0 | 500 | 0.06 | 1.50 | 0.06 | 10.40 | 200 | 4.00 | 60.00 | 0.00 | 0.99*) |
| 14 | 51.0 | 500 | 0.06 | 1.50 | 0.06 | 10.40 | 200 | 4.00 | 60.00 | 0.00 | 1.03 |
| 15 | 50.0 | 540 | 0.06 | 1.50 | 0.06 | 10.40 | 200 | 4.00 | 60.00 | 0.00 | 1.07*) |
| 16 | 50.0 | 500 | 0.06 | 1.55 | 0.06 | 10.40 | 200 | 4.00 | 60.00 | 0.00 | 0.90 |
| 17 | 50.0 | 500 | 0.06 | 1.50 | 0.06 | 10.40 | 240 | 4.00 | 60.00 | 0.00 | 0.83 |
| 18 | 50.05 | 501 | 0.06 | 1.51 | 0.06 | 10.40 | 207 | 4.00 | 60.00 | 0.00 | 0.94*) |
| Minimal limit states with the simultaneous exceeding the values of the pulp density (ρ), velocity (V), distance (h), and water saturation (B) | | | | | | | | | | | |
| 19 | 5.00 | 200 | 0.06 | 0.10 | 0.0001 | 7.70 | 50.00 | 4.00 | 60.00 | 0.00 | 97.77 |
| 20 | 4.90 | 200 | 0.06 | 0.10 | 0.0001 | 7.70 | 50.00 | 4.00 | 60.00 | 0.00 | 93.90 |

TABLE 1-continued

Optimization of the plume modes, medium and mix parameters on the value of the mix compaction factor on the basis of restraining $0.95 \leq K_U < 1$ for concretes having the filler aggregate size less than 16 mm $|K_U = ((\rho * V^2 * (\rho/(V * \rho b))/(h * S * B * \mu * \upsilon))/(R_P)|$

| Nos | ρ | V | υ | h | S | ϕ | B | μ | $R_P$ | γ | $K_U$ |
|---|---|---|---|---|---|---|---|---|---|---|---|
| 21 | 5.00 | 190 | 0.06 | 0.10 | 0.0001 | 7.70 | 50.00 | 4.00 | 60.00 | 0.00 | 92.88*) |
| 22 | 5.00 | 200 | 0.06 | 0.09 | 0.0001 | 7.70 | 50.00 | 4.00 | 60.00 | 0.00 | 134.11 |
| 23 | 5.00 | 200 | 0.06 | 0.10 | 0.0001 | 7.70 | 48.00 | 4.00 | 60.00 | 0.00 | 101.84 |
| 24 | 4.95 | 195 | 0.06 | 0.10 | 0.0001 | 7.70 | 49.50 | 4.00 | 60.00 | 0.00 | 110.07*) |

Remarks:

The value $K_U \geq 1$ means that in the set mode the mix components are destroyed in compaction without creating the monolith; the value $K_U < 0.95$ means the non-optimality of the component packing in the mix in compaction at the area of the plume placement $S = 3.14 * (h * (tg((\phi/2) * (3.14)/(180))^2)$.

*)Experimental composition

ρ - Pulp density, (ρ) = 5-50 kg/m$^3$

V - Pulp velocity in the plume mouth, (V) = 200-500 m/sec

υ - Coefficient of the dynamic medium viscosity, (υ) = 0.02-0.1 kgf * sec h - Distance from the plume mouth to the mix placement surface, (h) = 0.1-1.5 m S - Plume area at the placed surface, S = h * tg (ϕ/2), m$^2$ ϕ - Plume conicity angle, ($\phi_f$) = 5-15 degrees B - Water saturation, (B) = 50-200 l/m$^3$ μ - Coefficient of the pulp uniformity variation in the plume mouth, (μ) = 2-6%

$R_P$ - Strength limit when cracking the coarse filler, ($R_P$) = 20-100 kgf/cm$^2$ γ - Angle of the plume direction (γ) from minus 90 to plus 90 degrees $K_U$ - Compaction factor Essence of the Apparatus The apparatus for preparing and inertial placing with compacting the concrete mix in the vibration-free concreting is designed for implementing the method.

The apparatus is made in the form of a unified hermetically sealed system having a boost energy source (15) for ensuring the continuity of the steps of preparing, transporting and placing with compacting the mix without uniformity losses.

The apparatus comprises the mixing chamber (1) of the enforced action in the form of the horizontal cylinder reservoir for stirring with a pressure inlet, a loading port (9), and an unloading mechanism (14) in the bottom portion.

A central working shaft having a drive (29) is mounted in the mixing chamber (1) along the axis (28), which drives being made reversible and having a possibility for adjusting the velocity. The reversible drive having the possibility for adjusting the velocity ensures a possibility for stirring and unloading the chamber in various modes to obtain the mix uniformity in stirring and to maintain the mix uniformity in unloading.

In order for ensuring the maximal uniformity in stirring the mix, the blades (30) are mounted at an angle (34) between the plane in the vertical position and the axis of the shaft at the free ends of the holders fixed to the central working shaft perpendicularly to the horizontal axis thereof with the possibility for displacing the holders along the axis (28) and ensuring the blade overlap in the horizontal cross-section of the mixing chamber.

Figure 12:
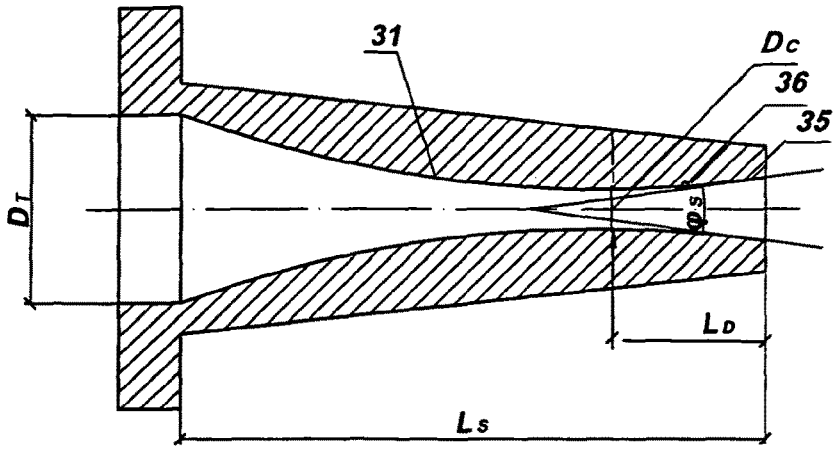
FIG. 12 represents the nozzle having the special complex configuration for discharging with reconstructing the transport stream and placing the concrete mix, which nozzle being made with the inner surface in the form of hyperboloidal semiplane and with the diffuser portion.

In order for ensuring the determined modes of the discharging for the steps of placing and compacting restricted by the method in accordance with the condition of the maximal uniformity of the concrete mix, the unloading mechanism (14) in the bottom portion of the mixing chamber is made in the form of the ejector nozzle (19) and ejector diffuser joined with the pipe-line of the pneumatic transport (2). The geometry and configuration of the pneumatic transport are implemented from the condition of the possibility for turbulent displacing the mix, and the discharging device for placing and compacting the mix in the form of the placing nozzle for forming the plume modes is made in the special complex configuration having the second-order guide surface convex inward the nozzle, and the diffuser (FIG. 12).

For the particular conditions of the method implementation, the holders are spaced at distances ensuring the overlap of the blades (30) in the horizontal cross-section of the mixing chamber by ⅓-¼ of the value of the adjacent semi-blades (32), and the nozzle (4) forming the plume (6) of the inertial displacement of the concrete mix in the space for placing and compacting thereof and having the complex configuration is made with the guide surface convex inward the nozzle in the form of the hyperboloidal semiplane (31) with the nozzle length $L_S$=(0.20-1.5), where $L_S$ is for nozzle length, m, with the diffuser at the output having the length $L_D=((D_t-D_C)/2\ tg(\phi_S/2))$, where $L_D$ is for length of the diffuser part of the nozzle, mm, $D_C$ is for nozzle diameter in the minimal cross-section, mm, $D_t$ is for nozzle diameter at the input in the maximal cross-section, mm, $\phi_S$=6°-15° is for conicity of the diffuser part of the nozzle.

The pressure of the pressure branch pipe for creating the boost pressure $D_n$ in the chamber is: $D_\Pi=(0.05\text{-}0.15)*D_\exists$, where $D_\exists$ is for ejection pressure.

At the input of the output nozzle could be mounted a device (3) of the aerosol wetting of the mix in the form of dispensers (18) directed against the technological stream of the mix being discharged.

Possibility for Implementing the Method

The method is implemented at the specially developed apparatus having the characteristics represented in the Table 2.

TABLE 2

Technical characteristics of the special cyclic high-speed (SCHS) apparatus for placing and compacting the concrete mixes without vibration

| Apparatus parameters | Model SCHS-1 | SCHS-2 | SCHS-3 |
|---|---|---|---|
| Productivity, $m^3$/hour | 2-4 | 4-6 | 6-10 |
| Diameter of the mixing chamber, mm | 500 | 650 | 800 |
| Length of the mixing chamber, m | 1.4 | 1.7 | 2 |
| Blade length for stirring the basic modifications, mm | 210 | 255 | 300 |
| Blade width | ⅓ of the blade length | | |
| Marginal values of the blade lengths for stirring with the provision of the semi-blade overlap value by ⅓-¼ of the adjacent blades, mm | 165-255 | 210-300 | 255-345 |
| Blade angle, degrees | 20-45 | | |
| Minimal quantity of the blade pairs being mounted | 6 | | |
| Value of the semi-blade overlap | ⅓-¼ of the adjacent blades | | |
| Frequency, rpm | 110 | 90 | 70 |
| Diameter of the output aperture of the ejector nozzle, mm | 89 | 100 | 125 |
| Optimal diameters of the pipe-line | 32 | 38 | 50 |
| Limiting lengths of the transporting pneumatic transport pipe-line confirmed testing, m | 160 | 240 | 350 |
| Maximal coarseness of the filler, fraction | 10-16 | | |
| Working mode | Cyclic | | |
| Air consumption, $m^3$/min | 5 | 8 | 15 |
| Working air pressure at the input of the pneumatic transport system, MPa | 1.4-5 | | |

The table 3 represents the results of the experimental data.

TABLE 3

Experimental data on the value of the coefficient of the pulp uniformity variation for the coarse filler in the volume unit of the mix (μ) at the constant composition of the concrete mix being prepared in the apparatus SCHS-1

| Stages of preparing and placing the mix | Coefficient of variation (μ), % |
|---|---|
| Calculation-theoretical coefficient of the variation | 2 |
| The step of preparing by stirring (the mix in the mixing chamber) | 3 |
| After, discharging, traditionally without compensating the stability failures | 8 |
| Unloading with compensating the stability failure - unloading by ejecting mated with changing the mode of the combined stirring | 4 |
| Stirring - unloading traditionally - transporting in the laminar mode | 11 |
| Stirring - unloading with compensating the stability failures - discharging (by ejecting mated with changing the combined stirring mode) - transporting in the turbulent mode | 4 |
| Stirring - unloading traditionally - transporting in the laminar mode - discharging with compacting without reconstructing the flow (coefficient of variation of the placed concrete mix) | 13 |
| Stirring - unloading with compensating the stability failure - discharging (by ejecting mated with changing the combined stirring mode) - transporting in the turbulent mode - discharging and compacting with reconstructing the flow (coefficient of variation of the placed concrete mix) | 6 |

Trials are performed for estimating the compaction factor in the age of 7 days for the plume modes, medium and mix parameters represented in the Table 1 and indicated by *): (1-5, 7, 8, 10-12, 13, 15, 18, 21, 24). In the concrete samples obtained, the compaction factor does not differ practically from the predictable ones.

Figure 13:
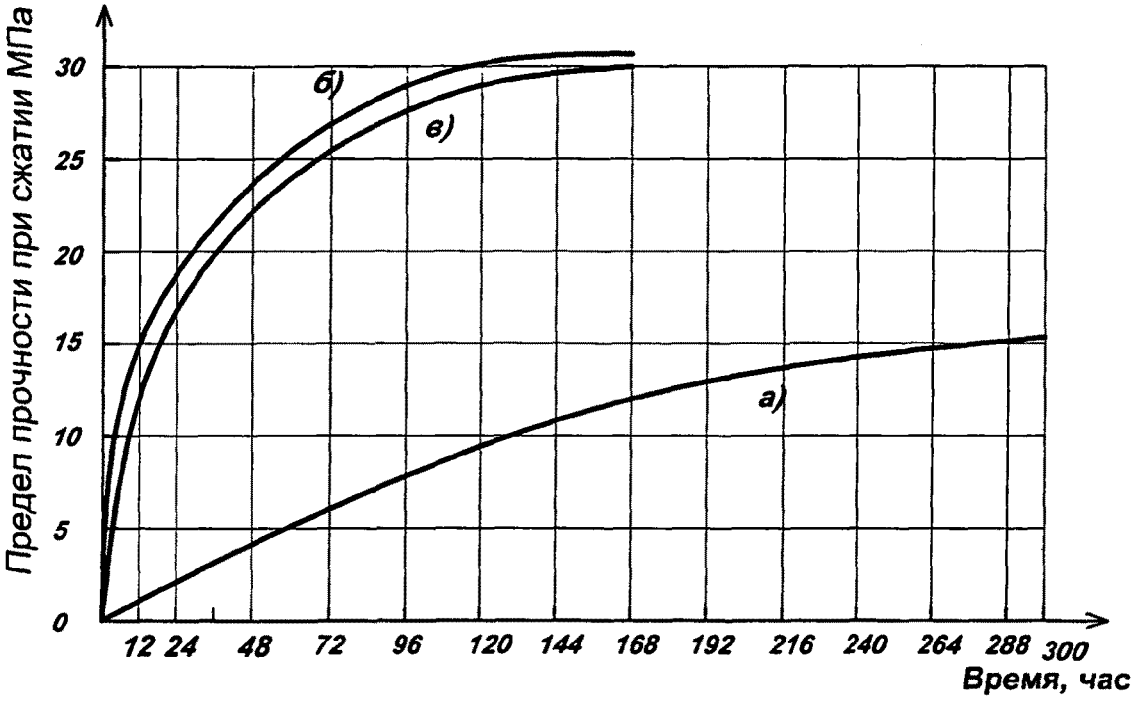
FIG. 13 represents the dependence of the strength limit under compression of the concrete sample cut from the massive: a) conventional shotcreting with the compaction factor of 0.93 to 0.96, b) inertial compacting with the compaction factor of 0.98 to 0.99, c) inertial compacting with the compaction factor of 0.95 to 0.97.
Figure 14:
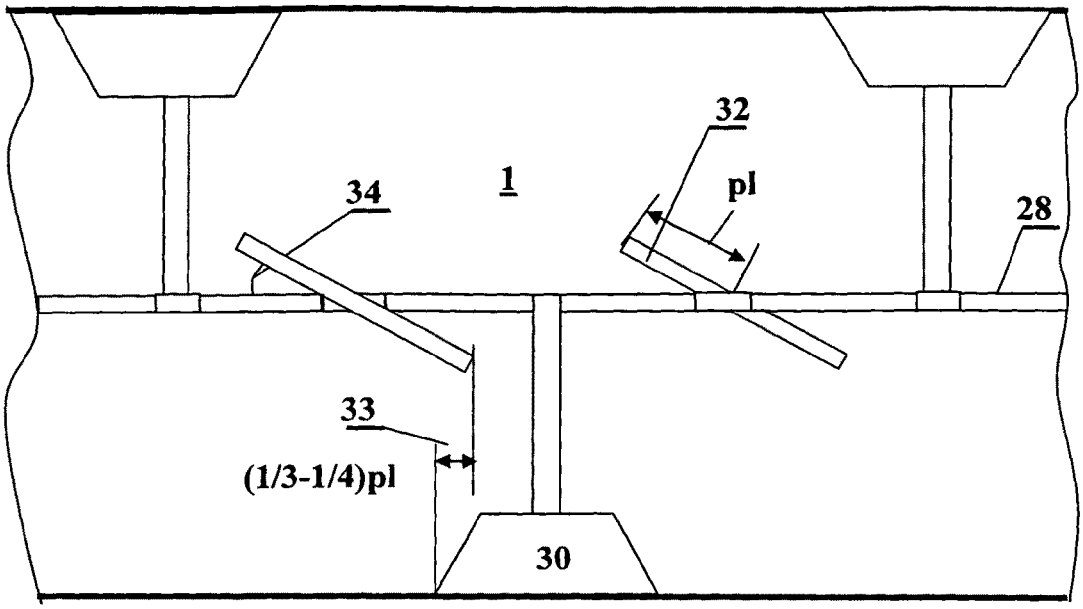
FIG. 14 represents the scheme of disposing the blades in the mixing chamber for stirring.

The strength indices of concretes in time are determined for said compositions (1-5, 7, 8, 10-12, 13, 15, 18, 21, and 24). FIG. 13 represents the results of the averaged trials of the strength limit under squeezing the concrete samples cut from the solid monolith in the age of 1, 3, 7 and 15 days when hardening in standard temperature-humidity conditions. The dependence (b) in FIG. 13 represents the data results for the modes having the compaction factor of 0.98 to 0.99 (Nos. 4, 7, 13 in the Table 1). The dependence (c) in FIG. 13 represents the data results for the modes having the compaction factor of 0.95 to 0.97 (Nos. 1, 2, 3, 5, 10, 11, 19 in the Table 1).

The trial results (not shown in FIG. 13) of the samples having the compaction factor less than 0.95 (Nos. 12, 18, 21 in the Table 1) showed that the strength reduces for all terms of hardening by 15-20% lower than corresponding indices of the dependence (c) in FIG. 13.

In the steps of placing and compacting the concretes according to the modes with the predictable compaction factor 1.0 and more, great losses of the mix (up to 60% in horizontal placing) were demonstrated (Nos. 8, 15, 24 in the Table 1). The results in placing with horizontal compacting down in these conditions have discovered the presence of non-uniformity of the placed mix with the dispersability in the strength up to 0.40.

The comparison of the results of the method implementation with the technical solution previously known from the apparatus prior art, and yet in a greater degree the comparison with the shotcreting technology (dependence (a) in the FIG. 13) confirm the occurrence of the unrehearsed effect, i.e., the increase of the compaction factor of the concrete mix and the strength indices, especially in the early terms of hardening, by means of stabilizing the mix uniformity in all steps in the unified serially connected system, variational assigning and implementing the integral indices of the mix parameters, and/or the plume modes, and/or the space medium characteristics, by the presence of the special modes for compacting, and by creating the respective apparatus for implementing the method.

The invention claimed is:

1. A method for preparing and inertial placing with compacting a concrete mix in a vibration-free placement of concrete, which method comprising stages of:

concreting under super-high pressure using a speed force inertial characteristic of components which stage being carried out by steps of:

cyclical forced preparing the mix in a mixing chamber, transporting the mix via a pipe-line, discharging in a stream for placing with compacting by means of sputtering the stream by a plume of inertial displacing the concrete mix in space taking into account a plume position and shape, wherein the steps in the stage of concreting under super-high pressure using a speed force inertial characteristic of components are joined into the continuous serial process of the steps of: preparing the mix, unloading and transporting thereof, reconstructing the stream, discharging the mix stream for placing with compacting thereof, the step of enforced cyclic preparing the mix in the mixing chamber being performed by means of stirring along with a combined movement of the components in the mixing chamber with a possibility for preparation the mix for uniform unloading, the step of unloading the mix from the chamber being performed by means of ejecting which is combined with a change of a combined stirring mode, the step of transporting the mix via the pipe-line being carried out in form of an air pulp having an average density of 5 to 50 kg/m$^3$ in a turbulent movement mode; the step of reconstructing the mix stream being transported, prior to discharging the mix stream for placing and compacting thereof, being performed by means of shaping a complex form of the stream with restraining the stream on the surface thereof with by second-order plane at a discharging velocity of 200 to 500 m/sec, the step of discharging being carried out using speed force inertial characteristics of the components of the reconstructed stream for placing with compacting by means of sputtering the stream with the plume of an inertial displacement of the concrete mix in the space taking into account the plume position and shape, with a possibility for adjusting and optimizing the compaction factor of the concrete mix with respect to complex indices of mix parameters, and/or plume modes, and/or space medium characteristics.

2. The method for preparing and inertial placing with compacting the concrete mix in a vibration-free placement of concrete in accordance with claim 1, wherein the step of concreting under a super-high pressure is performed from a single energy source pressure, the step of adjusting and optimizing the compaction factor of the concrete mix when concreting is performed using the speed force inertial characteristics of the mix components taking into account the plume position and shape with respect to the complex indices of the mix parameters, and/or the plume modes, and/or the space medium characteristics, according to a following dependence:

$$K_U=F(I_C,I_f,I_P)=F(\rho,\mu,B,K_Z,R_P,V,S,\phi_f,h,K_n,\upsilon_P),$$

where $K_U$ is for mix compaction factor at the placement surface;

F is for functional of the dependence of the compaction factor on the complex indices;

$I_C$ is for integral complex of the indices of the mix parameters;

$I_f$ is for integral complex of the indices of the functional plume modes;

$I_P$ is for integral complex characteristics of the space medium;

$\rho$, $\mu$, B, $K_Z$, $R_P$ is for integral complex $I_C$ of the mix parameter indices;

V, S, $\phi_f$ is for integral complex $I_f$ of the functional plume mode;

h, $K_n$, $\upsilon_P$ is for integral complex $I_P$ of the space medium characteristics;

$\rho$ is for pulp density of 5 to 50 kg/m$^3$;

$\mu$ is for coefficient of the pulp uniformity variation in the plume mouth;

B is for mix water saturation;

$K_Z$ is for coefficient of the loading volume of the transport system;

$R_P$ is for strength limit when cracking the filler;

V is for velocity of the plume at the placement surface;

S—is for a plume area at the placed surface;

$\phi_f$ is for plume conicity angle;

h is for distance from the plume mouth to the mix placement surface;

$K_n$ is for coefficient of the direction of the plume inertial displacement relative to the horizon;

$\upsilon_P$ is for dynamic coefficient of the space actuation medium.

3. The method for preparing and inertial placing with compacting the concrete mix in a vibration-free placement of concrete in accordance with claim 1, wherein the step of transporting the mix via the pipe-line is performed by a pneumatic transport in the form of air pulp in the turbulent mode of the movement thereof on the basis of Reynolds number Re≥1200, prior to the step of discharging the mix stream for placing and compacting the mix, the step of reconstructing the mix stream being transported is performed by shaping the complex form of the stream with restraining the stream at the surface thereof with a second-order plane formed by a hyperboloidal semiplane; the step of discharging the reconstructed stream for placing with compacting by sputtering the stream with the plume of the inertial displacement of the concrete mix in the space is carried out along with orienting a plume axis perpendicular to a surface using the speed force inertial characteristics of the mix components taking into account the plume position and shape, and along with adjusting the optimal compaction factor $K_U$ of the concrete mix within the range of:

$$0.95 \le K_U < 1,$$

in accordance with the product of the complexes of the mix parameter indices, functional modes of the plume and space medium characteristics according to the empirical dependence:

$$K_U = (I_C * I_f * I_P) = \frac{\rho V^2 K_Z}{hSB\upsilon_P \mu R_P} * \left(1 + \frac{\mathrm{Sin}(\gamma)}{gh}\right),$$

where $K_U$ is for mix compaction factor at the placing surface;

$I_C$ is for integral indices of the mix parameters;

$I_f$ is for functional modes of the plume;

$I_P$ is for space medium characteristics;

$$I_C = \frac{\rho K_Z}{B\mu R_P};$$

$$I_f = \frac{V^2}{S};$$

$$I_P = \left(\frac{1}{h\upsilon_P}\right) * \left(1 + \frac{\mathrm{Sin}(\gamma)}{gh}\right);$$

-continued $$S = f(h, \varphi_f);$$

$$\left(1 + \frac{\mathrm{Sin}(\gamma)}{gh}\right) = K_n;$$

under the following ratios of integral indices of the mix parameters, functional modes of the plume and space medium characteristics:

pulp density (ρ) of 5 to 50 kg/m$^3$;

pulp velocity at a mouth of the plume mouth (V) of 200 to 500 m/sec;

volume loading coefficient of a transport system $K_Z=\rho/(V^*\rho_b)$;

density of normal heavy concrete ($\rho_b$) of 2000 to 2500 kg/m$^3$;

distance from the plume mouth to the mix placement surface (h) of 0.1 to 0.5 m;

plume area at the placed surface $S=h^*tg(\phi_f/2)$, m$^2$;

plume conicity angle ($\phi_b$) of 6 to 15 degrees;

mix water saturation (B) of 50 to 250 l/m$^3$;

dynamic coefficient of a space actuation medium ($\upsilon_P$) of 0.02 to 0.1 kgf*sec;

coefficient of a pulp uniformity variation in the plume mouth (μ) of 0.02 to 0.12;

strength limit when cracking the filler ($R_P$) of 1 to 100 kgf/m$^2$;

angle of the inertial displacement direction of the plume relative to horizon (γ) from minus 90 to plus 90 degrees;

$$\left(1 + \frac{\mathrm{Sin}(\gamma)}{gh}\right) = K_n$$

is for coefficient of the inertial displacement direction of the mix in the space;

g is for normal acceleration.

4. The method for preparing and inertial placing with compacting the concrete mix in a vibration-free placement of concrete in accordance with claim 1, wherein the step of enforced preparing includes a step of cyclic loading into the chamber and stirring along with combined displacing the components in the mixing chamber, including the gravity and enforced displacements of the components combined with the horizontal enforced displacement of the mix;

the step of unloading from the chamber is performed by ejecting and creating a boost pressure $D_\Pi$ in the chamber equal to:

$$D_\Pi=(0.05-0.15)^*D_Э,$$

where $D_Э$ is for ejection pressure;

along with simultaneous inverting the direction of the enforced horizontal mix displacement when stirring; and it is possible to perform the step of transporting the mix via the pipe-line by the pneumatic transport in the form of air pulp in the turbulent mode of the mix displacement via the pipe-line.

5. The method for preparing and inertial placing with compacting the concrete mix in a vibration-free placement of concrete in accordance with claim 1, wherein, prior to the step of discharging the mix from the transport system for placing and compacting the mix, the step of reconstructing the mix stream being transported is performed by shaping the complex form of the stream by restraining the stream at the surface thereof with a second-order plane formed by a hyperboloidal semiplane along with diffuser widening the stream.

6. The method for preparing and inertial placing with compacting the concrete mix in a vibration-free placement of concrete in accordance with claim 1, wherein the step of cyclic enforced preparing includes the cyclic loading in the volume: $V_Z=K\cdot V_C$, where $V_Z$ is for loading volume, m$^3$, $V_C$ is for mixing chamber volume, m$^3$, K is for concrete mix yield factor equal to $0.8\geq K\geq 0.6$;

or in the volume: $V_Z=0.7\cdot V_C$, at the concrete mix yield factor $0.8<K<0.6$.

7. The method for preparing and inertial placing with compacting the concrete mix in a vibration-free placement of concrete in accordance with claim 1, wherein, prior to the step of unloading the mix from the chamber, the step of purging the system is carried out with clean air having the pressure equal to the pressure of unloading ejection:

$$De=D_\Pi+(D_T^*K_{tp}^*K_P)=D_P, \text{ where}$$

De is for ejection pressure, $D_P=f(V)$ is for operating pressure at the output of the transport system, V is for pulp velocity in the plume mouth, msec, $D_\Pi=(0.05-0.15)^*D_Э$ is for boost pressure in the chamber, $D_T$ is for pressure at the input of the transport system, $K_{tp}$ is for transportation loss factor, $K_P$ is for pressure loss factor in unloading.

8. The method for preparing and inertial placing with compacting the concrete mix in a vibration-free placement of concrete in accordance with claim 1, wherein, the step of reconstructing the mix stream being transported by shaping the complex form of the stream, the step of wetting the mix with a counter stream is performed.

9. An apparatus for preparing and inertial placing with compacting the concrete mix in the vibration-free concreting, which apparatus comprising:

an enforced action mixing chamber in the form of a horizontal cylindrical reservoir for stirring having a pressure inlet, a loading port, and an unloading mechanism in a bottom portion, a pneumatic transport system in the form of a pipe-line, and a discharging device for placing and compacting the mix, in the mixing chamber being mounted a central working shaft with a drive, blades each of which being mounted at an angle between a plane thereof in a vertical position and a shaft axis at free ends of holders, the holders being fixed to the central working shaft perpendicularly to a horizontal axis thereof, configured for moving the holders along the axis, an unloading mechanism in the bottom portion of the mixing chamber being made in the form of a chamber with an ejecting device in the form of an ejector nozzle and ejector diffuser coupled to the pneumatic transport pipe-line, at which output a discharging device being disposed for placing and compacting the mix, which discharging device being made in the form of a placing nozzle, wherein:

the apparatus being made in the form of a unified hermetically sealed system having a boost energy source, the drive of the central working shaft being configured reversible for adjusting the speed, the blades on the holders being configured for changing the angle and mounted at an angle, and the holders being spaced at a distance ensuring jointly the blade overlap in the horizontal cross-section of the mixing chamber, a geometry and configuration of the pneumatic transport being made on a basis of a turbulent mix displacement, the discharging device for placing and compacting the mix in the form of the placing nozzle for shaping plume modes is made in a special complex configuration having a second-order guide surface convex inward the nozzle and the diffuser.

10. The apparatus for preparing and inertial placing with compacting the concrete mix in the vibration-free concreting in accordance with claim 9, wherein:

the blades on the holders are mounted at an angle, and the holders are spaced at the distances ensuring the blade overlap in the horizontal cross-section of the mixing chamber for ⅓-¼ of the size of the adjacent semi-blades, the nozzle of the complex configuration shaping the plume of the inertial displacement of the concrete mix in the space for placing and compacting the mix is made with the guide surface convex inward the nozzle in the form of the hyperboloidal semiplane (or hyperboloidal paraboloid) with the nozzle length:

$$L_S=(0.20-1.5)m,$$

where $L_S$ is for nozzle length, with the diffuser at the output having a length:

$$L_D=(D_t-D_C)/2tg(\phi_S/2),$$

where $L_D$ is for length of the nozzle diffuser portion, $D_C$ is for nozzle diameter in the minimal cross-section, mm;

$D_t$ is for nozzle diameter at the input in the maximal cross-section, mm, $\phi_S$=6-15 degrees is for conicity of the nozzle diffuser portion.

11. The apparatus for preparing and inertial placing with compacting the concrete mix in the vibration-free concreting in accordance with claim 9, wherein the pressure of a pressure branch pipe for creating boost pressure $D_\Pi$ in the chamber is:

$$D_\Pi=(0.05-0.15)*De,$$

where De is pressure for ejection.

12. The apparatus for preparing and inertial placing with compacting the concrete mix in the vibration-free concreting in accordance with claim 9, wherein at the input of the output nozzle a device is mounted for aerosol wetting the mix in the form of dispensers directed against the stream of the mix being discharged.

* * * * *